US009211584B2

(12) United States Patent
Shibata et al.

(10) Patent No.: US 9,211,584 B2
(45) Date of Patent: Dec. 15, 2015

(54) WATER JACKET CORE

(75) Inventors: Kiyoshi Shibata, Tokyo (JP); Hideaki Yokoyama, Tokyo (JP); Koichi Sato, Tokyo (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 14/381,343

(22) PCT Filed: Feb. 22, 2012

(86) PCT No.: PCT/JP2012/054259
§ 371 (c)(1),
(2), (4) Date: Oct. 24, 2014

(87) PCT Pub. No.: WO2013/124983
PCT Pub. Date: Aug. 29, 2013

(65) Prior Publication Data

US 2015/0041097 A1 Feb. 12, 2015

(51) Int. Cl.
*B22C 9/10* (2006.01)
*B22C 9/24* (2006.01)
*B22C 21/14* (2006.01)

(52) U.S. Cl.
CPC . *B22C 9/103* (2013.01); *B22C 9/10* (2013.01); *B22C 9/24* (2013.01); *B22C 21/14* (2013.01)

(58) Field of Classification Search
CPC ..... B22C 9/10; B22C 9/103; B22C 9/24; B22C 17/2218
USPC ..... 164/271, 348, 369
See application file for complete search history.

(56) References Cited

U.S. PATENT DOCUMENTS 5,357,921 A * 10/1994 Katoh et al. ..... 123/193.2
2008/0115908 A1* 5/2008 Kim ..... 164/302

FOREIGN PATENT DOCUMENTS

JP 2001-164985 A 6/2001

OTHER PUBLICATIONS

Japanese Office Action mailed Dec. 10, 2013 and issued in corresponding JP patent application P2010-179218.

* cited by examiner

*Primary Examiner* — Kevin P Kerns
(74) *Attorney, Agent, or Firm* — Carrier Blackman & Associates, P.C.; William D. Blackman; Joseph P. Carrier

(57) ABSTRACT

A water jacket core (10) includes a base part (11) and is provided with an intermediate female thread part (15) in that base within a region surrounded by tangent lines (18, 19) that are parallel to a center line (17) passing through the centers of a plurality of bore pin insertion bores (12) for forming cylinder bores and are in contact with the bore pin insertion bores and by an intermediate position for the adjacent bore pin insertion bores.

5 Claims, 7 Drawing Sheets

22
29
15
11
24
31
32
41
37
33
34
25
26
BPF
47
46
44
45
36
35
42
40
43
30

WATER JACKET CORE

TECHNICAL FIELD

The present invention relates to an improvement in a water jacket core for forming, during cylinder block casting, a water jacket in a multi-cylinder engine cylinder block having a plurality of cylinder liners arranged in a line during casting of the latter

BACKGROUND ART

Cylinder blocks are manufactured by casting. In the case of a water-cooled engine, a water jacket needs to be provided in a cylinder block. The water jacket is made upon cylinder block casting simultaneously by means of a core.

A water jacket core is radially positioned by means of a bore pin and secured, via a mounting flange being integral with the bore pin, to a casting mold by means of a bolt (see FIG. 1 of Patent Literature 1, for example).

FIG. 7 hereof is a cross-sectional view illustrating a conventional water jacket core. A cavity 109 is defined by casting molds 97, 98, 99, 100 for forming a cylinder block. A cylinder liner 101 is placed against an outer periphery of a bore pin BP. A water jacket core 102 is positioned in such a manner as to surround the cylinder liner 101. The water jacket core 102 is secured to the casting mold 100 by means of a bolt 103.

The water jacket core 102 includes a base part 104 and a core body part 105.

Referring now to FIG. 8, description will be made as to the configuration of base part 104 of the water jacket core 102. A plurality of holes 107 (four in this example) that corresponds to the bore pins BP is formed in a bottom surface of the base part 104. A plurality of female thread parts 108 is formed in such a manner as to surround the holes 107. Top ends of the bolts 103 shown in FIG. 7 are threaded into the female thread parts 108 for fixing the core 102 to the casting mold 100.

During cast-forming, molten aluminum is poured into the cavity 109. When the molten metal is hardened, casting 111 of a multi-cylinder engine cylinder block is provided.

Upon separation of the water jacket core 102 by pushing the casting 111 out, the core body part 105 of the water jacket core 102 is liable to tilt or incline outwardly, as indicated by the angle $\alpha$ relative to a cylinder axial line 112, as shown in FIG. 9. Thus, the water jacket core 102 encounters tensioning and a warp stress during push-separation of product casting, leading to the deterioration of mass production durability.

The present inventors have studied the causes of the undesired deformation and noted thermal flow. In FIG. 7, part of the heat of the molten metal is transmitted from the core body part 105 to the base part 104 and further to the casting mold 100. Then, the heart is transmitted from the base part 104 to the casting mold 100 as shown by arrows in FIG. 10.

On the other hand, a Y-shaped part 113 provided between adjacent bores 107, 107 is positioned distantly from casting mold 100 and heated by the molten metal from plural directions. As a result, heat is accumulated in the Y-shaped part 113. It has been found that such heat causes the distortion as shown in FIG. 9.

Prevention of tilting of the water jacket core enables prevention of stress concentration in the core during the product casing push-out operation, thereby improving mass production durability.

PRIOR ART LITERATURE

Patent Literature

Patent Literature 1: Japanese Patent Application Laid-Open Publication No. H08-132210

SUMMARY OF INVENTION

Technical Problem

It is therefore an object of the present invention to provide a technique whereby tilting of a water jacket core is prevented to thereby improve mass production durability.

Solution to Problem

According to an aspect of the present invention, there is provided a water jacket core which comprises: a plurality of bore pin insertion holes for insertion of bore pins for forming cylinder bores; a core body part for forming a water jacket; a base part having a plurality of the bore pin insertion holes; and a plurality of female thread parts provided to the base part in such a manner as to surround the bore pin insertion holes, characterized in that an intermediate female thread part is provided in that region of the base part which is surrounded by a tangential line, extending parallel to a center line passing over centers of the bore pin insertion holes and contacting the bore pin insertion holes, and an intermediate position of adjacent ones of the bore pin insertion holes In a preferred form of the invention, the intermediate female thread part is provided to a cooling hole hollow-formed in the core body part and is capable of local forced-cooling of the core body part with a cooling fluid poured from a fluid supplying/collecting device threaded into the intermediate female thread part.

Advantageous Effects of Invention

In the invention, the Y-shaped part of the water jacket core is also provide with a female thread part (intermediate female thread part). As a result, water jacket core tilting can be prevented satisfactorily, thereby facilitating smooth casting operation.

Owing to the construction, heat is liable to be accumulated in the Y-shaped part. As a countermeasure, in the preferred form of the invention, the female thread part provided at that position is arranged to be water-cooled. As a result, it becomes possible to prevent thermal deterioration of the female thread part, thereby increasing the durability of the water jacket core.

BEST MODE FOR CARRYING OUT THE INVENTION

Figure 1:
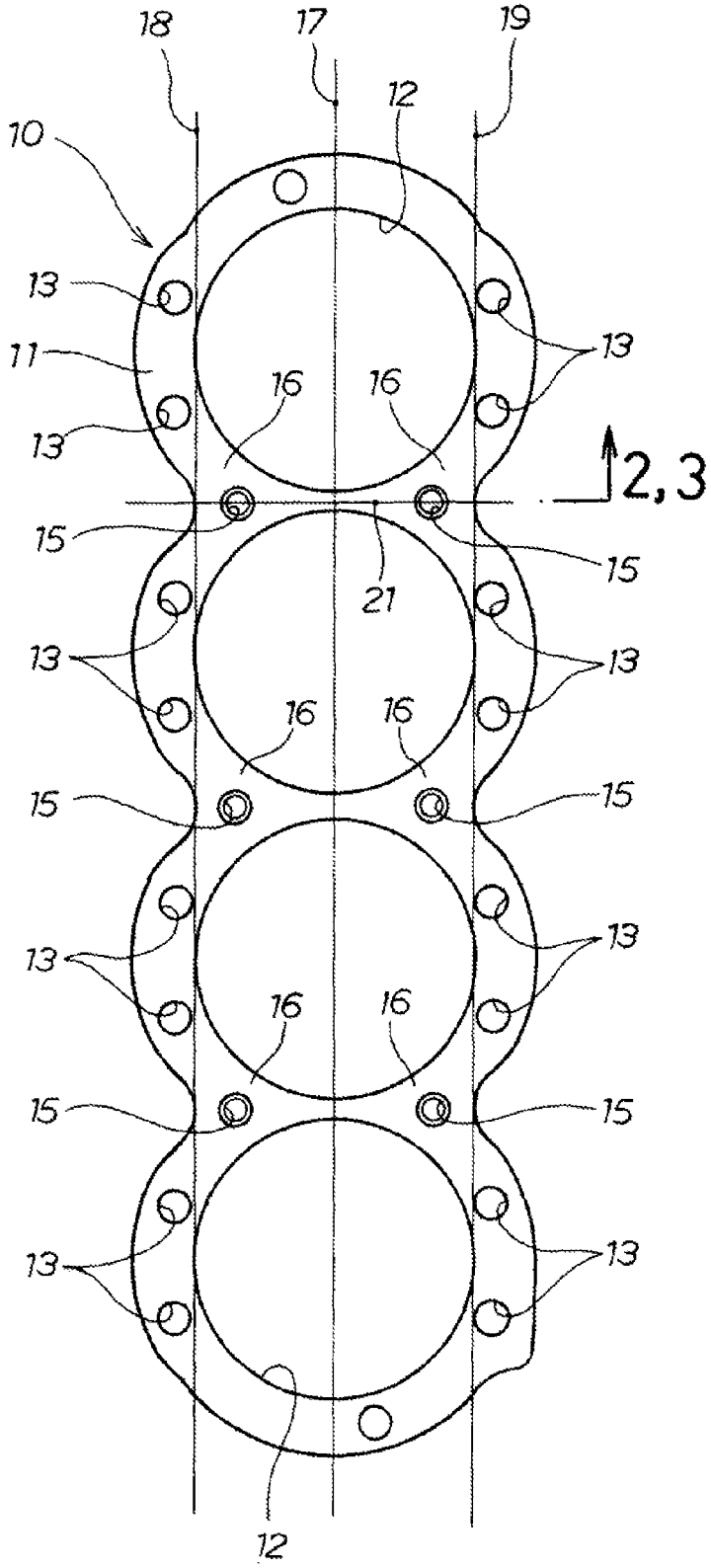
FIG. 1 is a bottom view of a water jacket core according to the present invention.

Preferred embodiments of the present invention will be described in detail below with reference to the accompanying drawings. Herein, the drawings should be viewed in orientations in which reference numerals are given.

Embodiment

As shown in FIG. 1, a water jacket core 10 has a base part 11 which is provided with a plurality of holes 12 (four in this embodiment) corresponding to cylinders, and with a plurality of female thread parts 13, 15 arranged in such a manner as to surround the respective holes 12.

Of the female thread parts 13, 15, the female thread parts 13 are provided externally of Y-shaped junction parts 16 defined between adjacent two holes 12, 12, while the remaining, intermediate female thread parts 15 are respectively provided at substantially central portions of the Y-shaped junction parts 16, as shown.

Locations of the intermediate female thread parts 15 will now be indicated precisely.

A center line 17 is drawn to pass over the centers of the holes 12. Drawn next are two lines 18, 19 that are tangential to the holes 12 and distant from the centers of the holes 12 by the radii of the latter. Then, a line 21 normal to the center line 17 is drawn to extend centrally between adjacent ones of the holes 12. The intermediate female thread parts 15, 15 are provided on the normal line 21 within that part of an area which is defined between the two tangential lines 18, 19 and close to the latter lines.

Details of the intermediate female thread parts 15 will be described with reference to FIG. 2. In addition, a modification of the embodiment of FIG. 2 will be described with reference to FIGS. 3 and 4.

Figure 2:
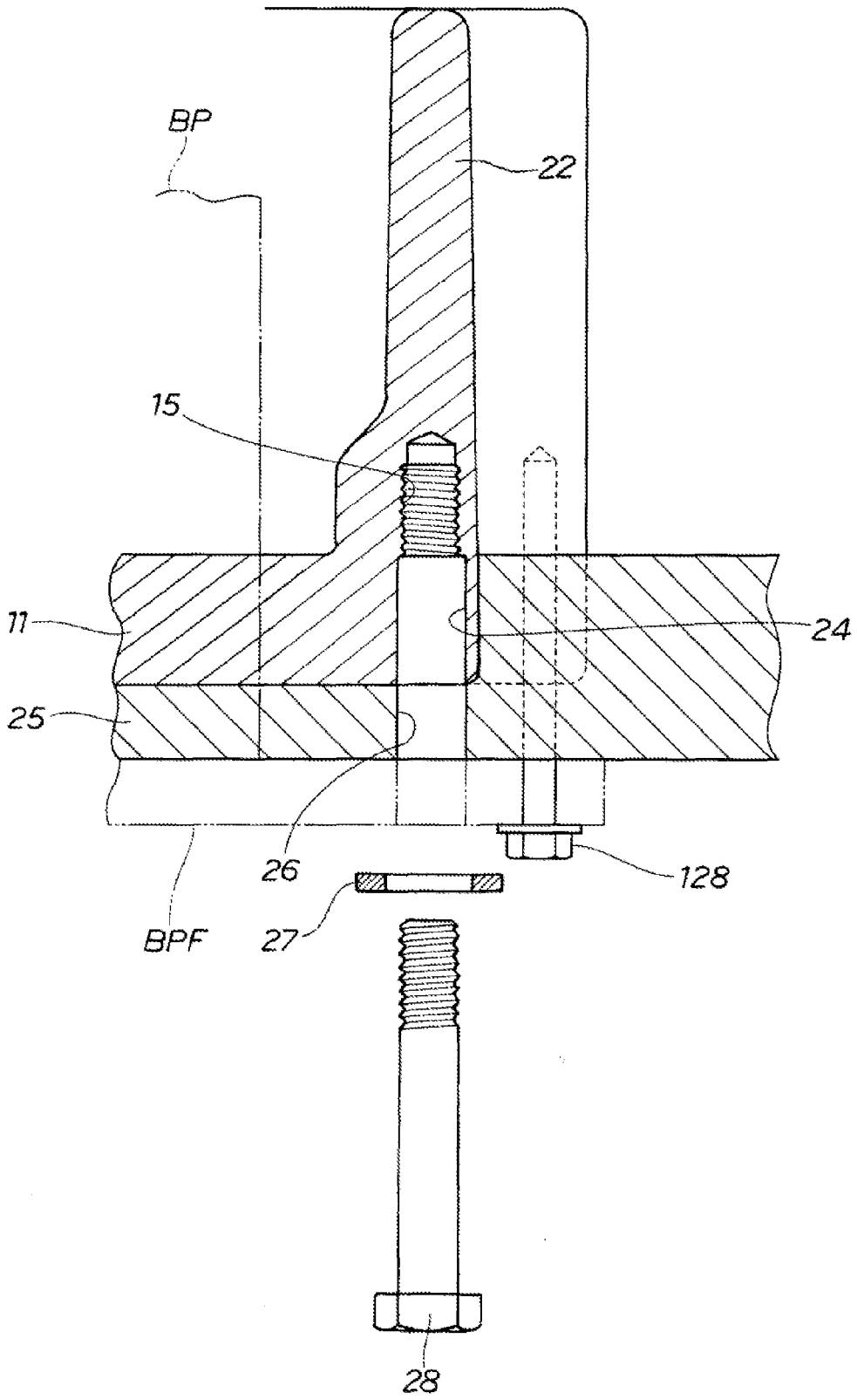
FIG. 2 is a cross-section view taken along line 2 of FIG. 1.

As shown in FIG. 2, each intermediate female thread part 15 is provided to extend from the base part 11 through a core body part 22. Casting mold 25 is also formed with a bolt hole 26. The base part 11 and the core body part 22 are secured to the casting mold 25 by aligning the bolt hole 24 of the base part 11 with the bolt hole 26 and a mounting hole formed in a flange part BPF of a bore pin BP as discussed in relation to the conventional art and inserting an intermediate part fastening bolt 28 from the casting mold side via a washer 27 into the core body part 22 until a distal end of the intermediate part fastening bolt 28 comes into threaded engagement with the female thread part 13.

Figure 3:
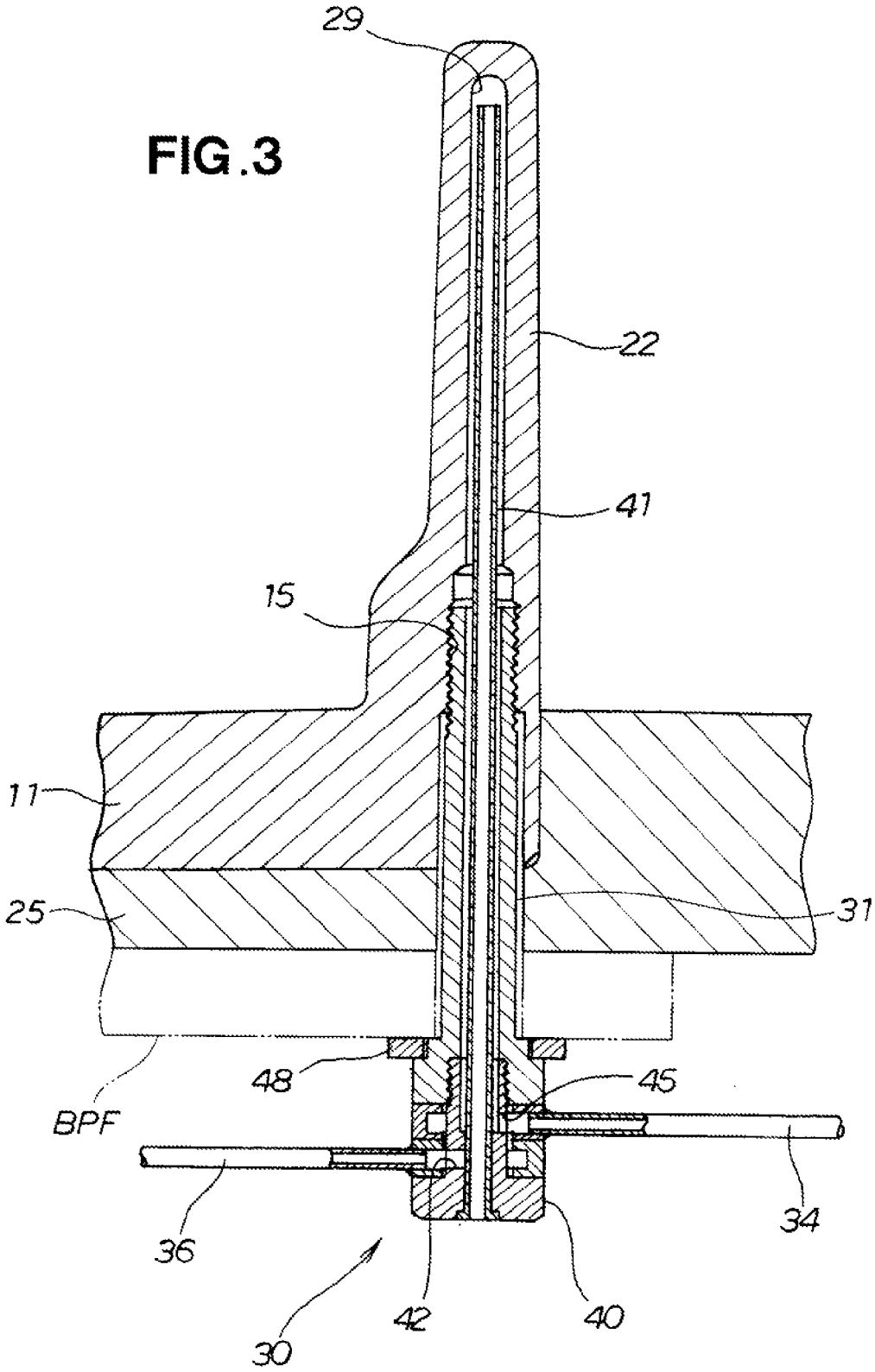
FIG. 3 is a cross-section view taken along line 3 of FIG. 1.
Figure 4:
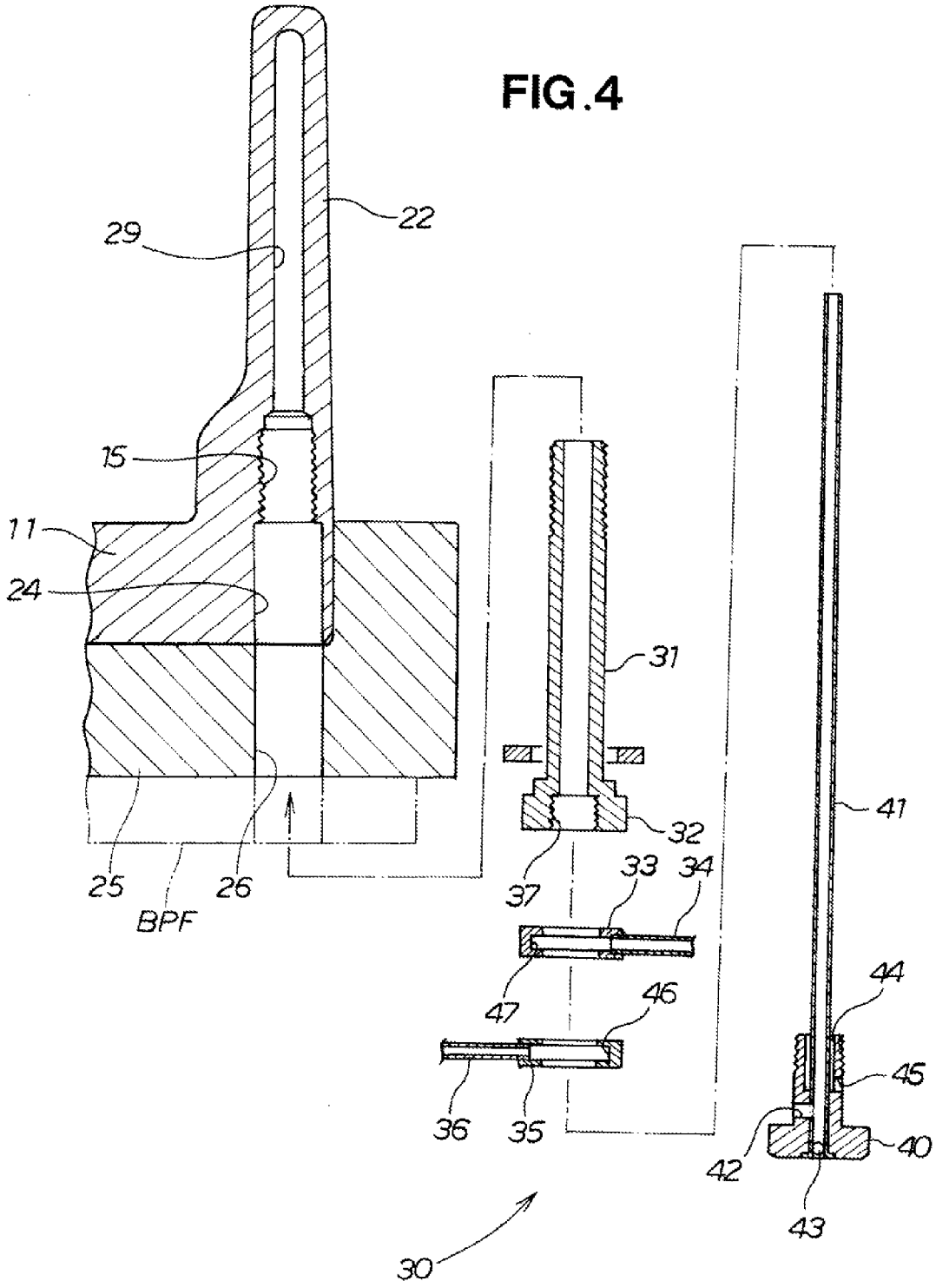
FIG. 4 is an exploded view of the arrangement of FIG. 3

On the other hand, in the modification of the FIG. 3, the intermediate part female thread part 15 comprises a hollow bolt having a water-cooling function. FIG. 4 is an exploded view illustrating constituent: parts that perform the water-cooling function shown in FIG. 3.

As shown in FIG. 4, the holt hole 24 is formed to extend from the base part 11 into the core body part 22. The intermediate thread part 15 is formed next to the bolt hole 24. Formed to extend through the core body part 22 is a cooling hole 29.

In the base part 11 and the core body part 22, the bolt hole 24, the intermediate female thread part 15 and the cooling hole 29 are formed in series in the order in which they are mentioned. A cooling fluid supplying/collecting device 30 is inserted into the bolt hole 24, the intermediate female thread part 15 and the cooling hole 29.

The fluid supplying/collecting device 30 is comprised of a hollow bolt 31, a waste fluid ring 33 to be held against a bolt head 32 of the hollow bolt 31, a waste fluid tube 34 extending from the waste fluid ring 33, a fluid supplying ring 35 to be held against the waste fluid ring 33, a fluid supplying tube 36 extending from the fluid supplying ring 35, a plug 40 for threaded engaged with a thread part 37 of the bolt head 32, and a cooling pipe 41 extending through the plug 40. The intermediate female thread part 15 and the thread part 37 are each in the form of a fine thread so as to prevent water leakage.

The plug 40 is formed with a first through-hole 42 for transferring refrigerant supplied through the fluid supplying ring 35 to the cooling pipe 41. The cooling pipe 41 has a base part (which is proximate to the plug 40) is closed by a closure piece 43. A clearance 44 is formed between a distal end inner periphery of the plug 40 and an outer periphery of the cooling pipe 41. The plug 40 also has a second through-hole 45 for allowing refrigerant passed through the clearance 44 to arrive at the waste fluid ring 33.

Since the plug 40 is turned, the azimuth of the first through-hole is indefinite. Thus, an annular groove 46 is formed in the fluid supplying ring 35 so that the refrigerant can flow from the fluid supplying tube 36 into the first through-hole 42 via the annular groove 46. Similarly, the waste fluid ring 33 is formed with an annular groove 47 so that the refrigerant can flow into the waste fluid tube 34 via the second through-hole 45 and the annular groove 47. Assembled form of the described components is shown in FIG. 3.

As shown in FIG. 3, since the hollow bolt 31 is passed through a spring washer 48 and threadedly engaged with the intermediate female thread part 15, the base part 11 and the core body part 22 can be firmly held in the casting mold against thermal expansion.

When the refrigerant (water, etc) is fed from the fluid supplying tube 36 into inside the cooling pipe 41 through the first through-hole 42, the refrigerant moves through the cooling pipe 41 toward its distal end so as to fill the cooling hole 29. The refrigerant cools the core body part 22 while moving.

Heated refrigerant moves outside the cooling pipe 41 toward the plug 40 and flows inside the hollow bolt 31 and through the second through-hole 45 and is discharged from the waste fluid tube 34. In this way, the intermediate female thread part 15 is cooled by the fluid supplying/collecting device 30.

Figure 5:
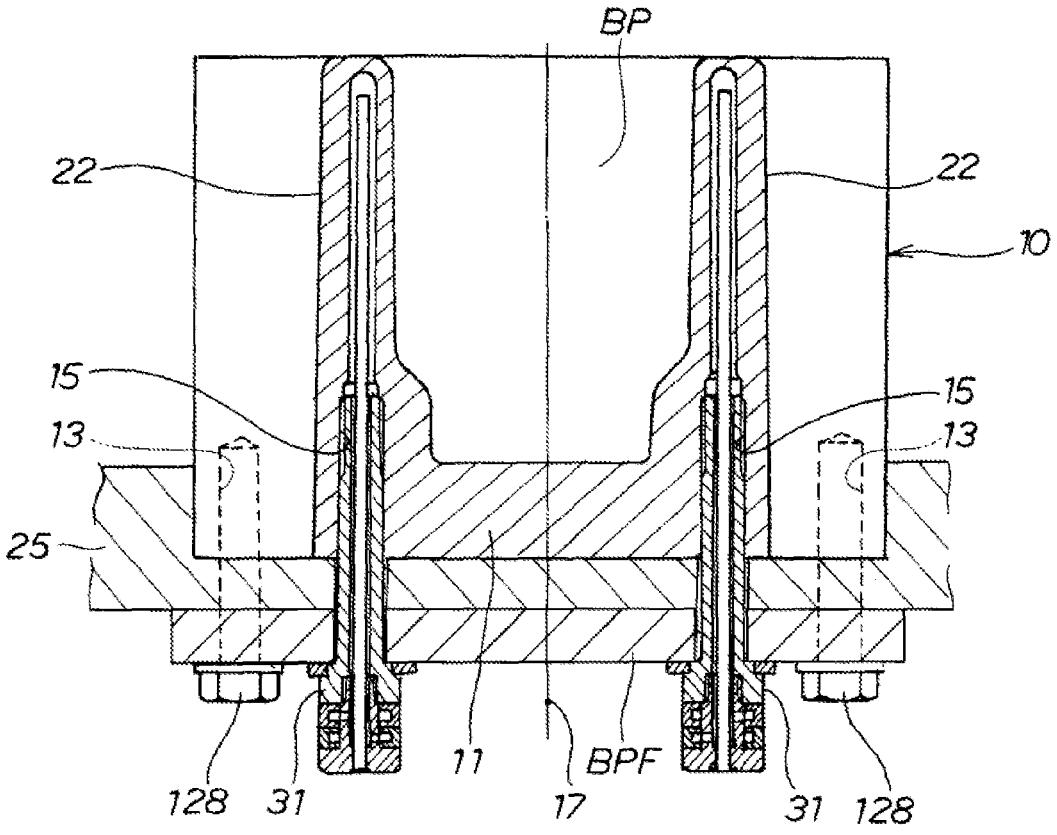
FIG. 5 is a cross-sectional view illustrating an operation of a hollow bolt.

As shown in FIG. 5, the water jacket core 10 is secured to the casting mold 25 by bolts 128, 128. In addition, the water jacket core 10 is fastened to the casting mold 25 by means of the hollow bolts 31, 31 at positions closer to a center line 17 than the bolts 128, 128.

If fastening is effected only by the bolts 128, 128, warping relative to the casting mold 25 arises in that part of the base part 11 which is in the vicinity of the center line 17, with the result that the core body parts 22, 22 diverge into a V shape or tilt.

The intermediate female thread part 15 of the present invention, according to the depicted embodiment, is provided with two intermediate female thread parts 15, 15 which are tightened by the hollow bolts 31, 31, thereby negating a fear of a gap being developed between casting mold 25 (even if developed, it may be very small) and the base part 11 and hence preventing tilting of the core body parts 22, 22. In the described embodiment, the intermediate female thread part 15 comprises a pair of right and left intermediate female thread parts but the number of such parts may be one or more. Also, bolt sizes may be different.

Note also that the hollow bolt 31 may be replaced by an ordinary bolt if thermal measures are taken for the casting mold 25 such as provision of water-cooling arrangements. Namely, when thermal problems are not serious, water-cooling arrangements may not be required.

Figure 6:
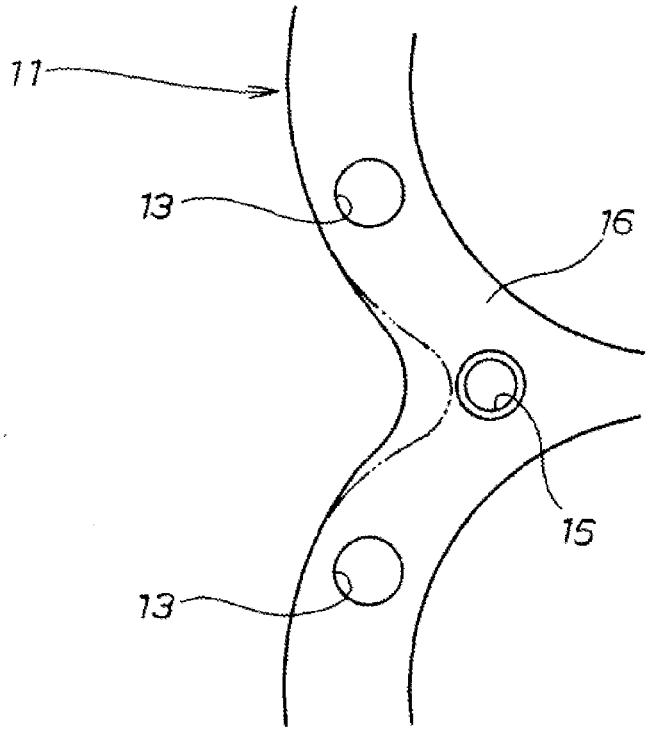
FIG. 6 is an enlarged view of a Y-shaped part of a base part.
Figure 7:
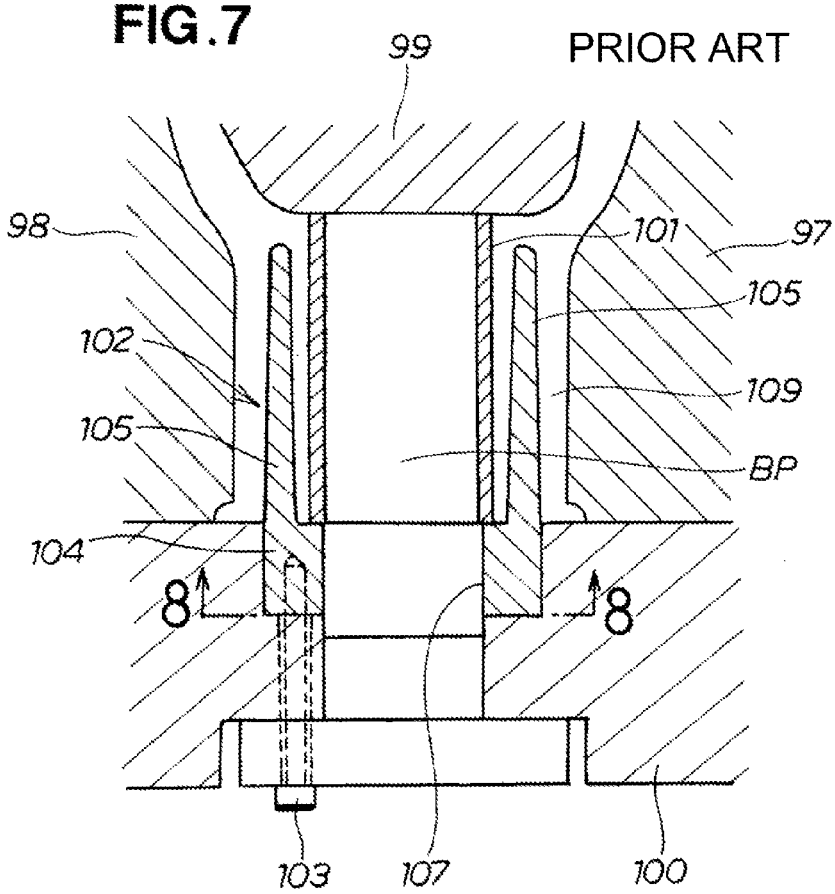
FIG.7 PRIOR ART
FIG. 7 is a cross-sectional view illustrating a conventional water jacket core.
Figure 8:
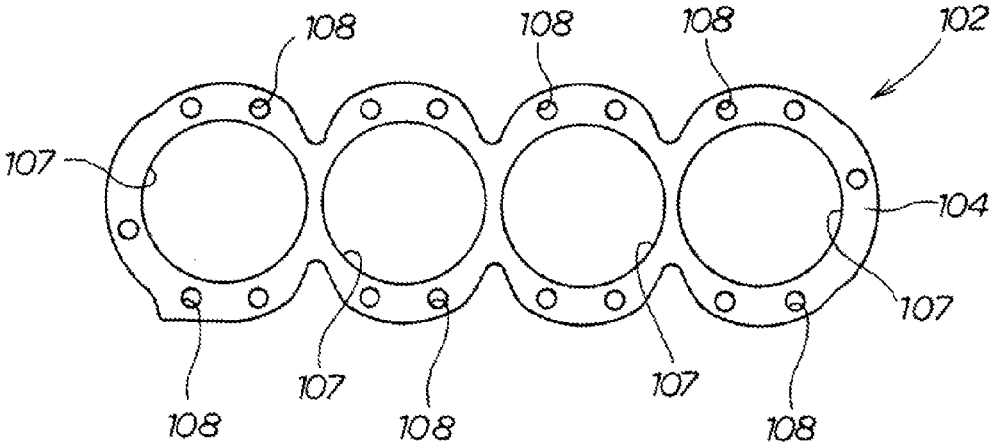
FIG.8 PRIOR ART
FIG. 8 is a view of the conventional water jacket core as seen in the direction of line 8 of FIG. 7.
Figure 9:
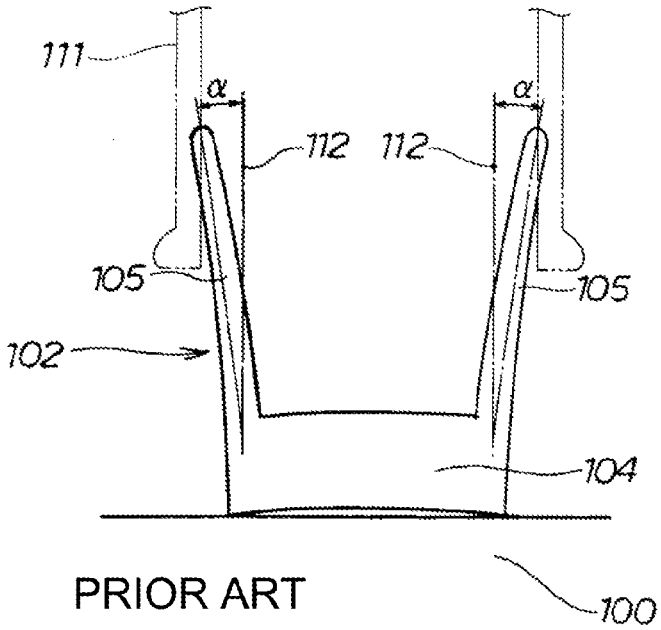
FIG. 9 is a view for explaining drawbacks of the conventional water jacket core.
Figure 10:
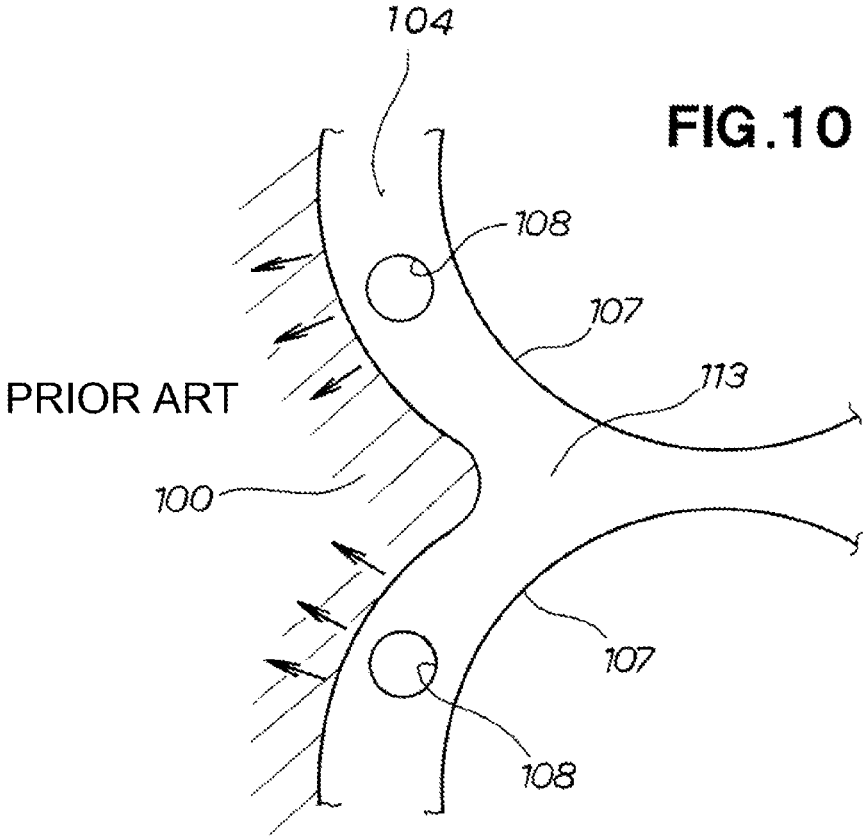
FIG. 10 is a view showing heat flow in the conventional arrangement.

It may readily be appreciated that the intermediate female thread part 15 to be provided to a Y-shaped part 16 shown in FIG. 6 may be arranged to be water-cooled.

In case the intermediate female thread part 15 is not provided, the outer periphery of the base part 11 may be concavely shaped at the Y-shaped part 16 as shown by a phantom line. When the intermediate female thread part 15 is provided in the Y-shaped part 16, as in the present invention, the outer periphery of the base part 11 may be pulled out, as shown by a solid line, so as to increase the area of the Y-shaped part 16 to thereby increase rigidity thereof.

Although discussion has thus far been made as to a water jacket core for use in casing a four-cylinder engine cylinder block, the number of cylinders may be two or more. It should also be noted that the arrangement of the fluid supplying/collecting device may be arbitrarily altered.

INDUSTRIAL APPLICABILITY

The present invention is particularly suitable for a water jacket core for use in casing a multi-cylinder cylinder block.

LIST OF REFERENCE NUMERALS

10 . . . water jacket core; 11 . . . base part; 12 . . . bore pin insertion bore; 13 . . . female thread part; 15 . . . intermediate female thread part; 16 . . . Y-shaped part; 17 . . . center line; 18, 19 . . . tangential lines; 21 . . . normal line; 22 . . . core body part; 25 . . . casting mold; 28 . . . intermediate fastening bolt; 29 . . . cooling hole; 30 . . . fluid supplying/collecting device; 31 . . . hollow bolt; 101 . . . cylinder liner; 128 . . . fastening bolt; BP . . . bore pin

The invention claimed is:

1. A water jacket core comprising:

a plurality of bore pin insertion holes for insertion of bore pins for forming cylinder bores;

a core body part for forming a water jacket;

a base part having a plurality of the bore pin insertion holes; and a plurality of female thread parts provided to the base part in such a manner as to surround the bore pin insertion holes, characterized in that an intermediate female thread part is provided in that region of the base part which is surrounded by a tangential line, extending parallel to a center line passing over centers of the bore pin insertion holes and contacting the bore pin insertion holes, and an intermediate position of adjacent ones of the bore pin insertion holes.

2. The water jacket core of claim 1, wherein the intermediate female thread part is provided to a cooling hole hollow-formed in the core body part and is capable of local forced-cooling of the core body part with a cooling fluid poured from a fluid supplying/collecting device threaded into the intermediate female thread part.

3. A water jacket core for use as a component in casting an engine block, said water jacket core comprising:

a base part having a plurality of bore pin insertion holes formed therein for insertion of bore pins for forming cylinder bores, the base part comprising a plurality of substantially cylindrical sections integrally joined together and including junction parts which are generally Y-shaped as viewed in a lower plan view of the base part; and a core body part integrally attached to the base part and provided for forming a water jacket in the engine block during said casting, the core body part having a plurality of female threaded bores formed therein, where some of the female threaded bores are respectively formed in the junction parts;

wherein at least some of the junction parts of the base part have hollow bores formed therein for receiving fasteners, each of the hollow bores communicating with one of said female threaded bores.

4. The water jacket core of claim 3, wherein each of the junction parts has a cooling hole formed therein in fluid communication with one of the corresponding female threaded bores, the cooling hole configured to permit local forced-cooling of the core body part with a cooling fluid poured from a fluid supplying/collecting device.

5. The water jacket core of claim 3, wherein the core body is configured to receive a separate cylindrical liner therein for each of the bore pin insertion holes during casting of the engine block.

* * * * *